US005361788A

United States Patent [19]

Cole et al.

[11] Patent Number: 5,361,788

[45] Date of Patent: Nov. 8, 1994

[54] APPARATUS FOR DESCALING METAL STRIP

[75] Inventors: John M. Cole, West Bloomfield; Charles M. Bessey, Plymouth Township, Wayne County, both of Mich.

[73] Assignee: Kolene Corporation, Detroit, Mich.

[21] Appl. No.: 119,496

[22] Filed: Sep. 10, 1993

Related U.S. Application Data

[62] Division of Ser. No. 926,528, Aug. 5, 1992, Pat. No. 5,272,798.

[51] Int. Cl.[5] ..... B08B 3/02

[52] U.S. Cl. ..... 134/64 R; 134/104.4; 134/105; 134/122 R

[58] Field of Search ..... 134/64 R, 104.4, 105, 134/107, 108, 122 R

[56] References Cited

U.S. PATENT DOCUMENTS 4,454,618 6/1984 Curchod ..... 12/1 R
4,517,696 5/1985 Schartz ..... 12/1 R
4,827,867 5/1989 Takei et al. ..... 134/105 X
4,876,758 10/1989 Rowff et al. ..... 12/142 N
5,113,882 5/1992 Gileta ..... 134/108 X

FOREIGN PATENT DOCUMENTS 569906 6/1945 United Kingdom ..... 134/107

*Primary Examiner*—Philip R. Coe
*Attorney, Agent, or Firm*—Calfee, Halter & Griswold

[57] ABSTRACT

A system for descaling a strip of metal includes a nozzle assembly mounted within a spray box for spraying descaling product on the strip. The nozzle assembly includes a spray chamber; nozzles mounted directly to the spray chamber; and a heater for heating the chamber, the descaling product in the chamber, and the nozzles by conduction through the chamber. The nozzles are oriented to direct the descaling product in a spray against the upper and lower surfaces of the metal strip for an amount and a time sufficient to descale the metal strip. The nozzle assembly is attached to the spray box and can be easily removed therefrom for inspection.

19 Claims, 4 Drawing Sheets

APPARATUS FOR DESCALING METAL STRIP

This is a divisional of copending application(s) Ser. No. 07/926,528 filed on Aug. 5, 1992, and now U.S. Pat. No. 5,272,798.

FIELD OF THE INVENTION

The present invention relates generally to a method and apparatus for descaling metal strip or sheet by treatment with fused alkali salt.

BACKGROUND OF THE INVENTION

Various methods are known for descaling hot metal strip (or sheet) in a continuous annealing line of a production facility. One method for descaling metal strip is generally referred to as "fused alkali treatment", in which the undesired oxide coatings on the exterior surfaces, which are formed during the rolling or annealing procedures, are removed using fused (or molten) alkali salts for the purpose of improving the strip surface-either for further processing, or as an end product. To complete the descaling, the metal strip is further processed, such as for example, by rinsing, quenching, and/or immersion for a short period of time in an acid bath (i.e., "acid pickling"). The fused alkali treatment can be used to descale a variety of alloys of metal strip, such as stainless steel, nickel, cobalt and titanium alloys.

Various types of apparatus have been proposed in the industry for effecting this descaling process. For example, an immersion tank is used wherein metal strip is immersed in a bath of mixed alkali metal hydroxides or salts. To guide the strip into and out of the molten bath, metal rolls typically are used to support the metal strip. Using metal rolls, however, can scratch and mar the surface of the strip through the presence of insoluble particles on the strip and/or the relative movement between the hot strip and the rolls.

Additionally, an immersion tank requires a considerable amount of space in the processing line of the production facility. Further, it has been determined that the descaling salts interact rather quickly with the scale on the strip, in fact typically quicker than the time it takes the steel to travel through the bath. Hence, using an immersion tank to descale a metal strip in a continuous annealing line can be inefficient by "overconditioning" the strip with excessive salt contact. Overconditioning the surface of the strip can make it more difficult to clean the strip in the subsequent acid pickling.

Methods and apparatus have been developed where descaling salts are applied directly to the metal strip in a spray after the strip leaves the annealing furnace. Spray systems generally reduce overconditioning of the strip and can have a scale loosening, scouring or scrubbing action which facilitates oxidizing the scale. For example, one technique is shown in Faler, U.S. Pat. Nos. 3,126,301 and 3,174,491, both of which are owned by the assignee of the present invention, wherein the metal strip is supported by tension through the descaling system. The molten salt in Faler is atomized within a spray box using large quantities of a gas, such as superheated steam. The steam is passed into nozzles through which is fed small quantities of the molten salts. The nozzles for applying the atomized salt are illustrated as being located centrally of the strip and directed toward opposite surfaces thereof. Steam is also provided through steam nozzles into the atmosphere of the oven for a general heating of the atmosphere to prevent any non-atomized salt from solidifying and contacting the strip.

Another method for descaling metal strip is shown in Hirata, et al, U.S. Pat. No. 4,251,956, in which a descaling slurry is applied to a surface of the strip from a nozzle array. The nozzle array comprises four sets of nozzles mounted between a supporting column and a connecting rod. The nozzle array is positioned in spaced relation to the strip surface and is directed toward the strip surface at an acute spray angle relative to the direction of movement of the strip.

Still other spray descaling systems using a plurality of nozzles located across the width of the strip are shown in McClanahan, et al, U.S. Pat. No. 4,361,444, and Hiroshima, U.S. Pat. No. 3,617,039.

Although the above-described descaling systems provide certain benefits in spraying salt across the surfaces of the metal strip for descaling, as well as reducing or eliminating metal rolls contacting the strip, these systems are not without drawbacks. For example, some of these systems require a large array of nozzles which are located at various orientations relative to the surfaces of the strip, such as shown in Hirata. However, providing a large array of nozzles increases the over-all cost of the descaling system, as well as increases the possibility that one or more of the nozzles will become damaged or clogged.

Moreover, none of the previous descaling systems provide nozzles which can be simply and easily removed from the descaling system, inspected, and repaired or replaced if necessary. As indicated above, the nozzles can have a tendency to become damaged or clogged when used over long periods of time, and it is sometimes necessary to access the nozzles (and related equipment such as pumps and heaters), such that repair or replacement can be made. However, when nozzles are connected to pipes mounted over and traversing the metal strip (such as shown in Hirata), access to the nozzles can be limited and difficult.

In any case, there is a constant demand in the industry for descaling systems which effectively and efficiently descale metal strip in a continuous annealing line of a production facility.

SUMMARY OF THE INVENTION

The present invention provides a new and useful spray descaling system having a simple nozzle array for spraying descaling salts on a heated metal strip in an annealing line of a production facility. The nozzles are mounted to one side of the metal strip and distribute the molten salt transversely across the metal strip to completely cover the strip. Further, the nozzles are mounted to a self-contained nozzle assembly which can be easily attached to and removed from the spray descaling system thereby allowing inspection of the nozzles (or other nozzle assembly components) and repairing or replacement thereof should they become damaged, clogged or otherwise unusable.

The spray descaling system of the present invention includes a spray box which receives the hot metal strip (or sheet) from the annealing furnace and discharges the strip to an acid pickling bath. The nozzle assembly includes an upper and lower pair of spray nozzles which direct molten salt against the strip to descale the strip. The upper pair of nozzles are directed downwardly at an angle relative to the upper surface of the metal strip and transversely across the strip from one side; while the lower pair of nozzles are directed upwardly at an angle relative to the bottom surface of the strip, and also transversely across the strip from the one side. The spray nozzles are designed to direct the fused salt across the top and bottom surfaces of the metal strip as the strip passes through the spray box so as to completely cover the metal strip.

The spray nozzles are mounted directly to a spray chamber in the nozzle assembly. The spray chamber receives the molten salt from a salt furnace and includes a heater to maintain the salt in its molten state. The heater also heats the nozzles by conduction through the spray chamber to a temperature above the melting point of the salt to prevent the salt from clogging the nozzles during spraying. Both the spray chamber and the nozzles are preferably preheated before the molten salt is introduced into the chamber to prevent the salt from initially freezing in the spray chamber and/or clogging the nozzles.

The nozzle assembly, comprising the spray chamber, nozzles and heater, is mounted within an opening formed in the side of the spray box. The nozzle assembly can be easily removed from the spray box for inspection by withdrawing the spray chamber through the opening. The nozzles and associated components can then be inspected, cleaned, and repaired or replaced if they become damaged, clogged or otherwise unusable, and the nozzle assembly re-mounted on the spray box.

After the molten salt is applied to the metal strip, steam wipes mounted in the wipe area of the spray box spread the molten salt across the surfaces of the strip. The excess molten salt then drains off the strip into a pan and can be directed back to the salt furnace for re-use. A spray water rinse in the rinse area of the spray box directs water against the surfaces of the strip to remove any remaining salt. Air and/or steam blow-offs in the rinse area then dry the strip before the strip is directed to the acid pickling tank for further processing.

Accordingly, it is a basic object of the present invention to provide an improved salt descaling method and apparatus which operates effectively and efficiently in descaling hot metal strip, particularly in a continuous annealing line of a production facility.

It is another object of the present invention to provide a salt descaling method and apparatus having a nozzle assembly which can be simply and easily mounted to and removed from a spray box for inspection and consequently repair and/or replacement of the nozzles or other nozzle assembly components if necessary.

It is still another object to provide a metal strip which is supported by tension through a spray box such that marring or scratching of the hot strip is prevented.

It is still another object of the present invention to provide a salt descaling method and apparatus which includes a spray chamber to maintain the salt in its molten stage and nozzles mounted to the spray chamber to distribute the salt on the surfaces of the metal strip, wherein the spray chamber and nozzles are initially preheated above the melting temperature of the salt to prevent the salt from freezing in the spray chamber and from clogging the nozzles before and during the spraying process.

It is still another object of the present invention to provide a new salt composition for a spray descaling apparatus.

Further objects to the present invention will become apparent from the following detailed description and accompanying drawings which form a part of the specification.

DETAILED DESCRIPTION OF THE PREFERRED EMBODIMENT

Figure 1:
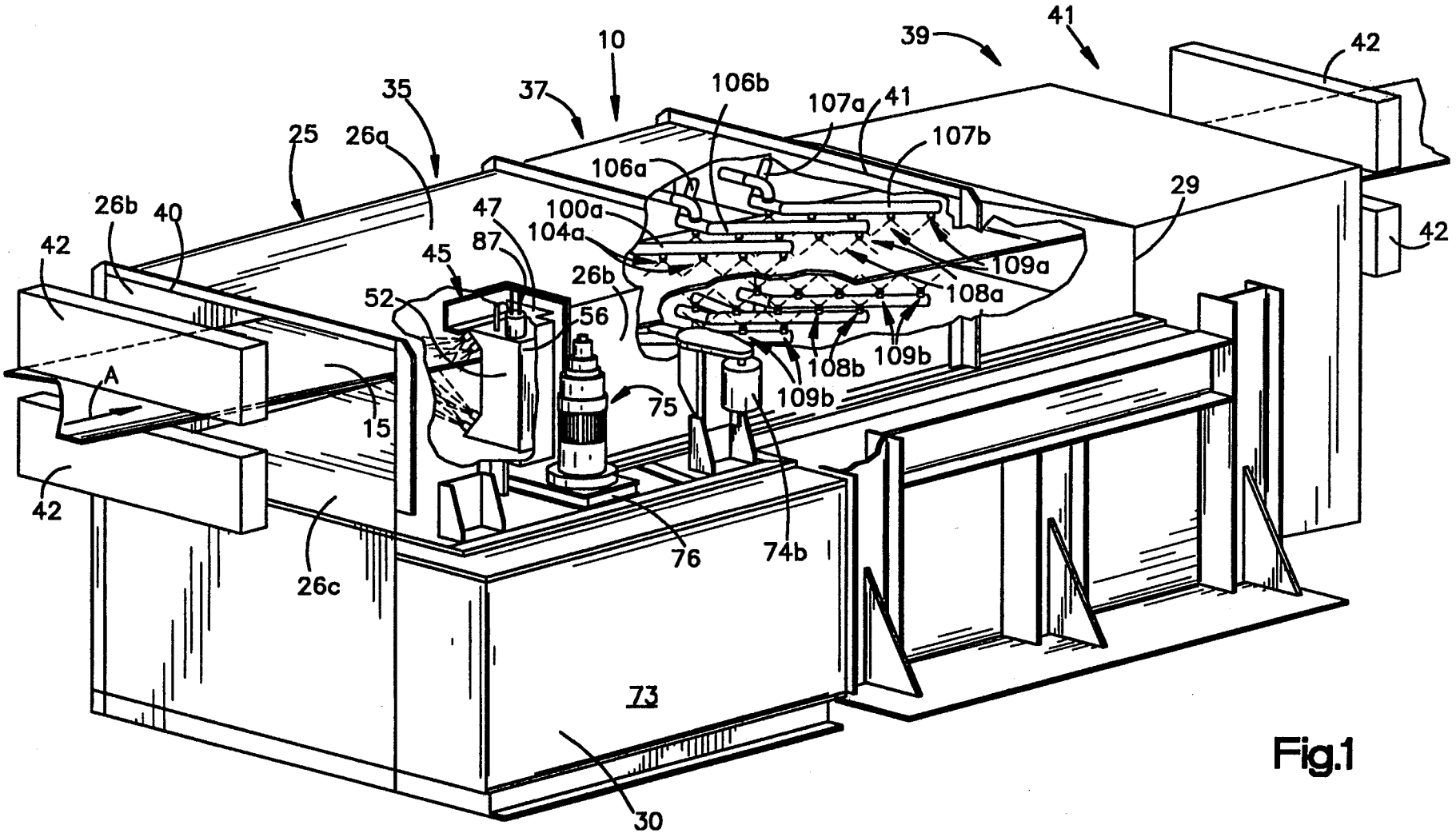
FIG. 1 is a perspective view somewhat diagrammatic of the spray descaling system constructed according to the principles of the present invention with portions shown cut-away.
Figure 2:
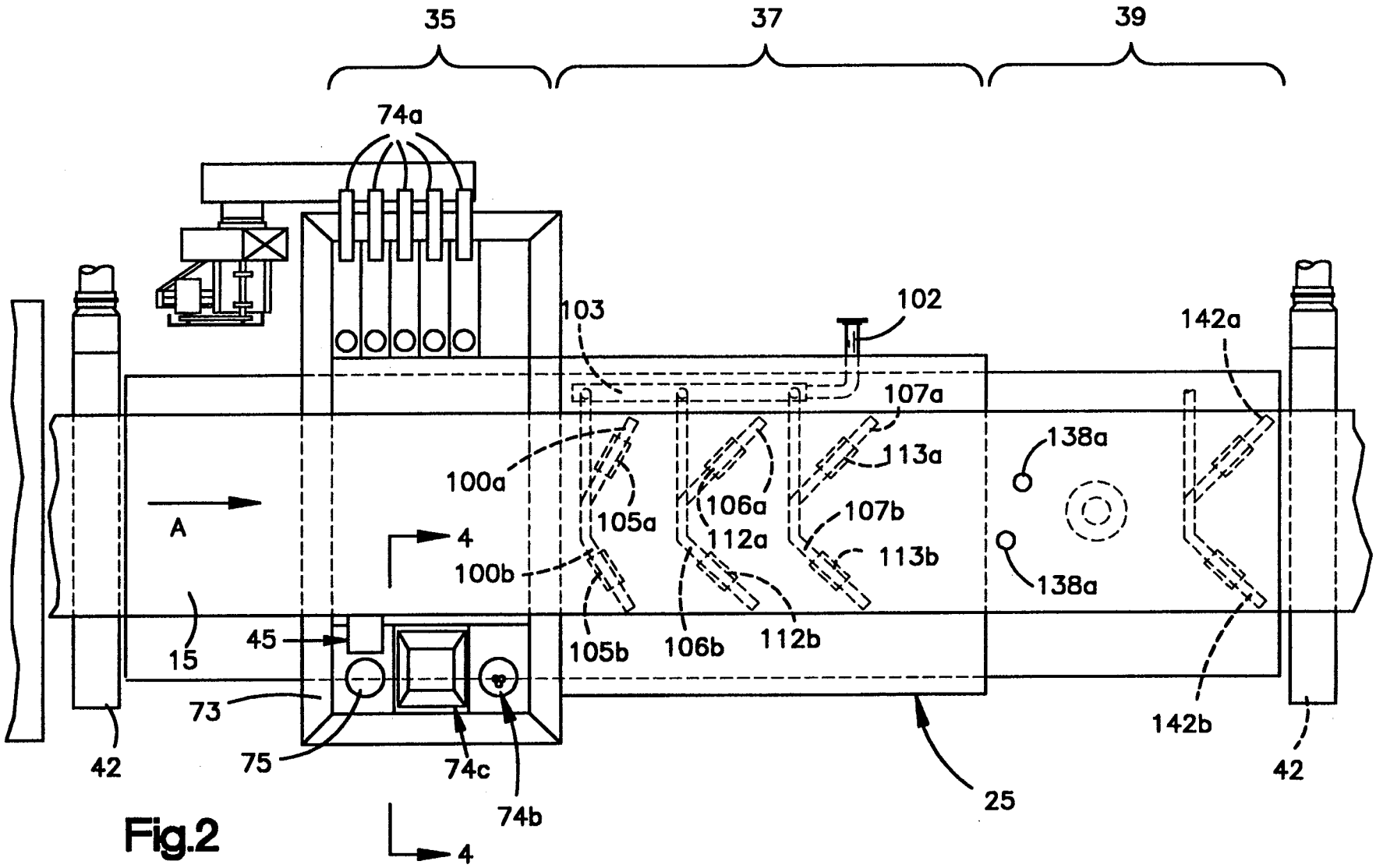
FIG. 2 is a top plan schematic illustration of the spray descaling system of FIG. 1.
Figure 3:
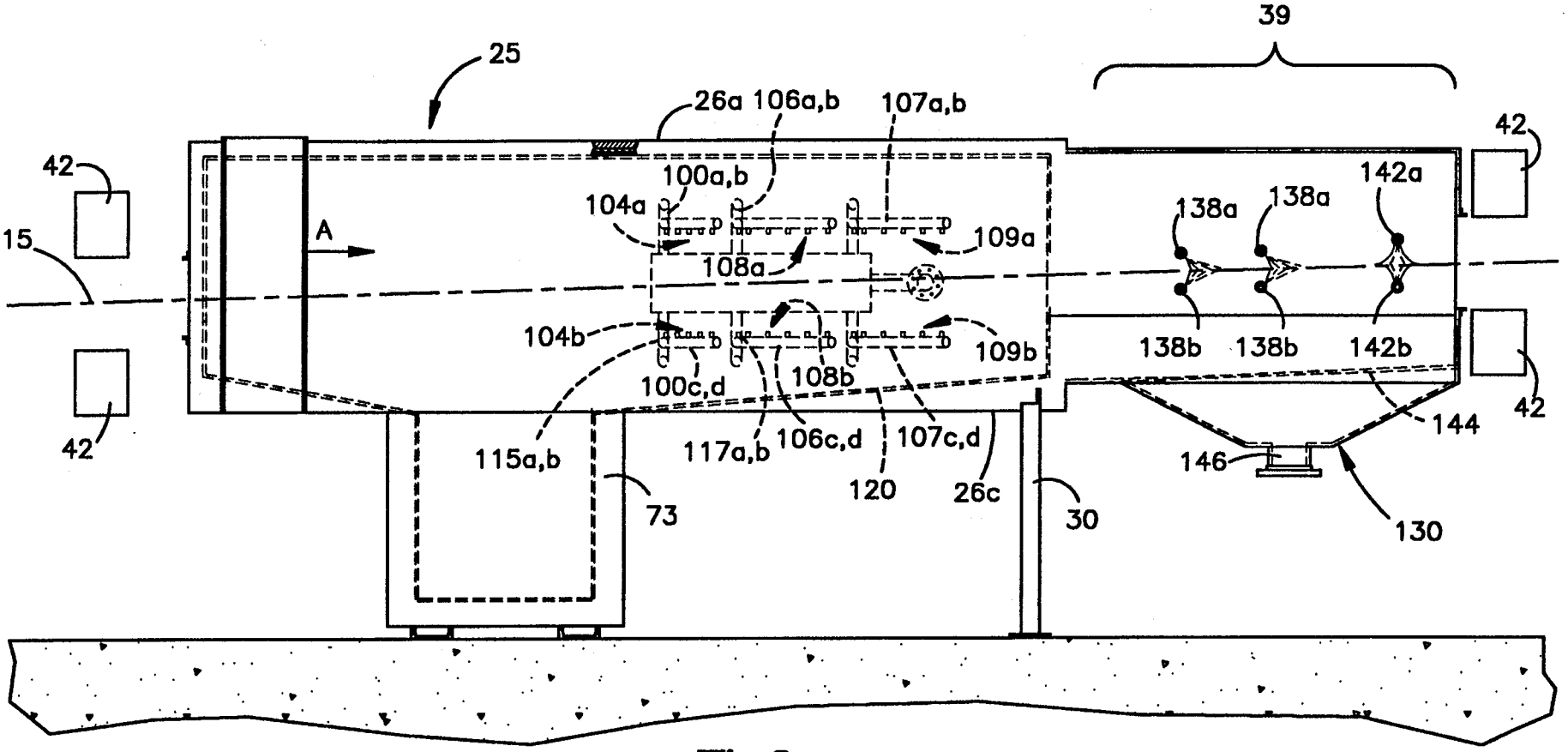
FIG. 3 is a side elevational schematic illustration of the spray descaling system of FIG. 2.

Referring to the drawings, and initially to FIGS. 1–3, a spray descaling system is illustrated generally at 10, wherein hot metal strip 15 emerges at a predetermined speed from an annealing furnace (not shown) having an output temperature of approximately 2050° F. (1121° C.) in the processing line of a production facility. The hot metal strip 15 typically then enters a cooler section wherein the strip is cooled to a temperature of between about 1000° F. (538° C.) and 1200° F. (650° C.) for an alloy such as stainless steel. However, as will become apparent upon reading the following specification, the present invention can be equally applicable to metal strip (or sheet) formed of other alloys (e.g., titanium, nickel or cobalt) which develop oxide coatings on the surface during annealing or other processing. The temperature to which these alloys are cooled might be slightly different than indicated above.

The metal strip from the cooler section passes through a spray box, indicated generally at 25, in the spray descaling system at the pass line height of the annealing furnace in the direction labeled "A". The strip can be supported by rolls or rollers (not shown) located remote from the spray box, but is preferably supported by tension through the spray box. As the strip enters the spray box, the strip has cooled to a temperature of between about 1000° F. (538° C.) and 1200° F. (650° C.).

The spray box 25 for the spray descaling system comprises a box-like, insulated structure having steel top wall **26*a*, side walls 26*b* and bottom wall 26*c* welded at the corners and supported on a frame or support structure 30. The spray box and frame are constructed using conventional welding and fabricating techniques and materials. The spray box includes a spray area, indicated generally at 35, a steam wipe area, indicated generally at 37, and a rinse area (both water and air blow-off), indicated generally at 39. The strip enters the spray box from the cooler section through opening 40, and exits through opening 41 (FIG. 1) robe further processed, for example in an acid pickling bath. To prevent any salt spray escaping from the spray box to the surrounding environment, vacuum boxes 42** can be mounted at the entrance and exit of the spray box both above and below the metal strip to collect the escaping salt spray.

Figure 4:
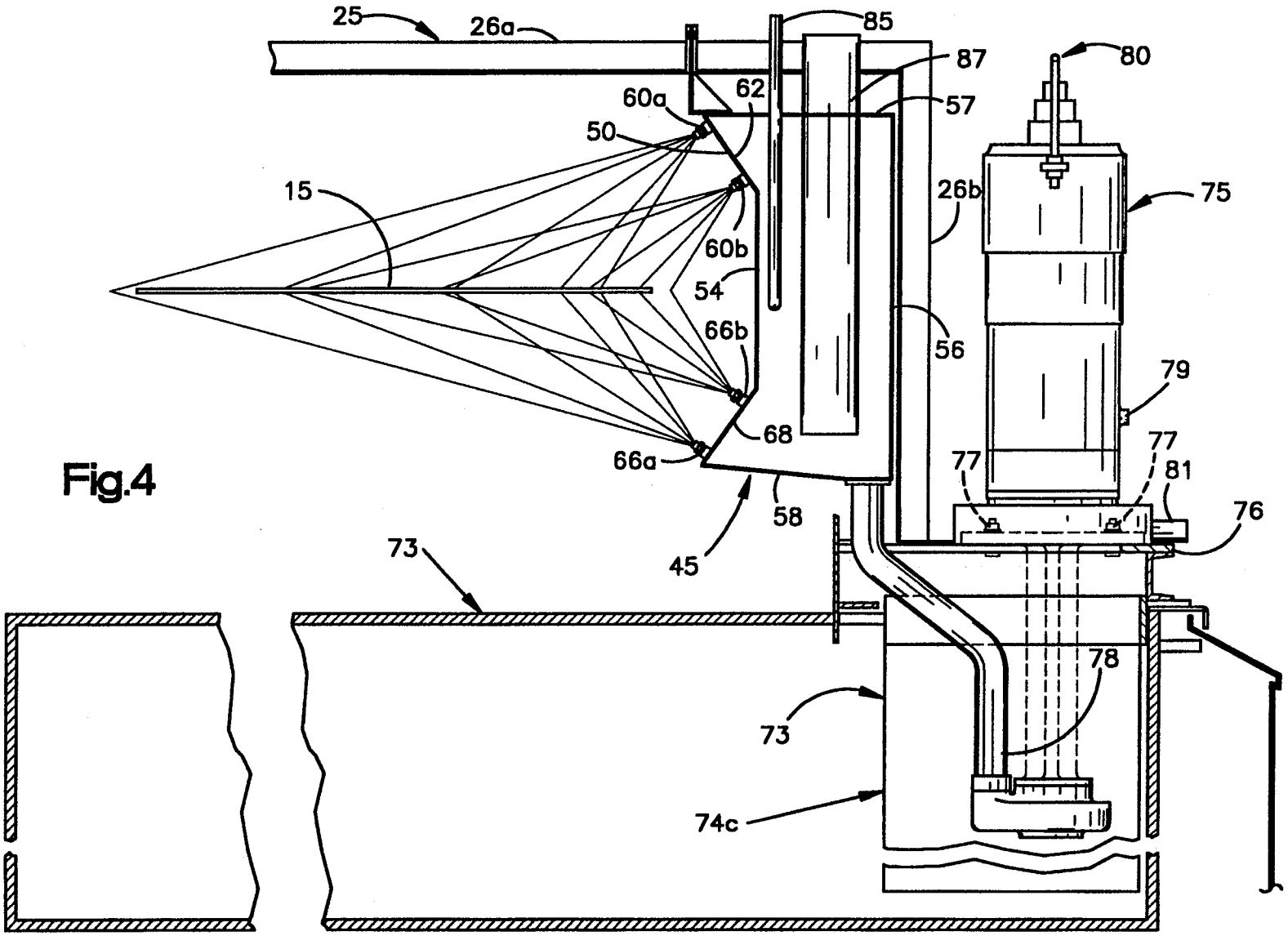
FIG. 4 is an enlarged, cross-sectional front view of the spray box taken substantially along the plane designated by the line 4—4 of FIG. 2.

Molten salt is applied to the metal strip to descale the strip in the spray area 35 of the spray box. To this end, a nozzle assembly, indicated generally at 45, is mounted within an aperture 47 formed in the side wall **26*b* of the spray box 25. As shown in detail in FIG. 4, the nozzle assembly 45 comprises a self-contained unit having a spray chamber 50 with side walls 52 (FIG. 1), front wall 54 and rear wall 56, which, along with top wall 57 and bottom wall 58**, form a fluid-tight enclosure. The walls are welded or otherwise attached together along the edges and are preferably formed from material which is non-reactive with the molten salt, but which conducts heat evenly throughout, such as nickel, or nickel-based alloys.

The nozzle assembly 45 further includes an array of nozzles which are mounted directly to the front wall 54 of the spray chamber 52. In particular, the nozzle array includes an upper pair of nozzles 60A, 60B, mounted to an upper angled portion 62 of the front wall 54; and a lower pair of nozzles 66A, 66B, mounted to a lower angled portion 68 of the front wall 54. The upper and lower angled portions 62, 64 are formed such that the nozzles 60A, 60B and 66A, 66B are directed downwardly and upwardly, respectively, toward the metal strip 15 at a predetermined angle.

Preferably, the nozzles are directed at approximately a 55° angle (measured from the plane of the strip) toward the upper and lower surfaces, respectively, of the metal strip such that molten salt sprayed through the nozzles impinges upon and completely covers the upper and lower surfaces of the strip. The value of the specific angles is not critical other than to position the nozzles 60A, 60B, 66A, 66B to spray the salt across the entire upper and lower surface of the strip as will be described herein. The nozzles are mounted on the spray chamber towards one side of the strip and direct the spray transversely across the strip as the strip moves through the spray box.

The nozzles 60A, 60B and 66A, 66B are preferably formed from metal or other heat conductive material and are in heat-exchange (i.e., conductive) relationship with the front wall of the spray chamber. The nozzles are preferably flat, fan-type hydraulic nozzles which spray the molten descaling salt across the surfaces of the metal strip; however, it is also within the scope of the invention to use other conventional nozzle-type devices, including openings or apertures in a pipe, to apply the molten descaling salt in a continuous stream against the surfaces of the metal strip. All such nozzle-type devices will be generally referred to hereinafter as "nozzle device".

The salt is supplied from a remote source such as a tankwagon or other storage facility (not shown) to a salt furnace, indicated generally at 73. The salt is preferably spray-added into the salt furnace using the techniques described in Wood et al, U.S. Pat. No. 4,455,251 and Shoemaker et al, U.S. Pat. No. 4,113,511, both of which are owned by the assignee of the present invention, and which are incorporated herein by reference. The salt is maintained in the salt furnace in a molten state (approximately 500° F. (260° C.) to 1100° F. (593° C.)). The salt furnace can include a heating device (e.g., burner tubes **74*a* immersed in the salt), agitator 74*b* to continuously circulate the molten salt, and screens, filters and/or a sludge pan, indicated schematically at 74*c* in FIG. 2**, to filter out undesirable impurities in the salt.

The molten salt is pumped from the salt furnace 73 to the spray chamber 50 for spraying on the metal strip. To this end, an immersion pump, preferably operated with a variable speed motor indicated generally at 75, is mounted on a platform 76 along the side of the spray box 25 and attached thereto with fasteners such as bolts 77. The immersion pump is conventional in design and designed to operate in high temperature, corrosive situations. The immersion pump preferably operates at 5 gpm at 26 ft. head to draw the molten salt from the salt furnace 73 and force the molten salt through pipe or conduit 78 into an opening (not numbered) in the bottom of the salt spray chamber. The pump includes a cooling water inlet 79 and outlet 80 to circulate water to cool the pump during use. A preferred pump of the type just described is manufactured by the Gusher Pump Company.

The salt in the spray chamber is maintained in its molten state by a control system including a heater 87 (e.g., an electric resistance or gas-fired heater) which extends through an opening formed in the top wall 57 of the spray chamber and is in direct contact with the portion of the spray chamber surrounding the opening. When the heater 87 is activated, the heater maintains the salt within the spray chamber at a temperature above its melting point, and preferably at a temperature of between 500° F. (260° C.) and 1100° F. (593° C.). The heater also heats the walls of the spray chamber by conduction through direct contact, by convection through heating of the molten salt in the spray chamber, and by radiation. The control system also includes a thermocouple 85 which can be mounted to and extend into the spray chamber to sense the temperature of the empty chamber or molten salt within the spray chamber and periodically activate the heater 87 when necessary, and a timer (not shown).

Additionally, since the nozzles are mounted directly to the spray chamber, the nozzles are also heated by the heater by conduction through the walls of the spray chamber. The nozzles are also preferably maintained at a temperature above the melting point of the salt, and preferably at a temperature of approximately 900° F. (482° C.), to prevent the salt from clogging the nozzles during the spray process, particularly when the salt is initially pumped into the spray chamber.

In fact, prior to the immersion pump supplying the molten salt to the spray chamber, a "preheating" function is performed for the salt descaling system. More particularly, the heater 87 is activated until a predetermined temperature above the melting point of the salt is obtained in the spray chamber. Preheating the chamber prevents salt from initially "freezing" on the walls of the chamber when the pump is activated and the salt is introduced into the chamber. The nozzles are also preheated in this manner above the melting point of the salt by conduction through the spray chamber. Preheating the nozzles also prevents the salt from initially clogging the nozzles.

In operation, the spray chamber and nozzles are initially preheated above the melting point of the salt as described above. The molten salt in the salt furnace is then supplied to the spray chamber by the immersion pump. The molten salt fills the spray chamber and flows out through the nozzles in a spray. The molten salt is applied through the nozzles at a low pressure (approximately 5 psi) as the immersion pump operates. The nozzles spray the molten salt on the strip to essentially cover the upper and lower surfaces of the strip. Moreover, the angle at which the nozzles direct the molten salt toward the strip, and the location of the nozzles on the side of the strip properly distribute the salt across the upper and lower surfaces of the strip. When the spraying process is complete, the immersion pump is turned off, and the salt is allowed to drain out of the nozzles and the salt chamber into the salt furnace before the heater is deactivated.

The nozzle assembly 45 is removable mounted within the opening 47 formed in the side of the spray box. Flanges can be formed on one or both of the spray chamber and the spray box such that the nozzle assembly 45 can be mounted thereto with fasteners (e.g., nuts and bolts). When it is necessary or desirable to remove the nozzle assembly, the bolts 77 mounting the immersion pump to the platform 76 are removed, and the nozzle assembly and immersion pump are withdrawn from the spray box. Since the nozzles are mounted directly to the spray chamber, removing the nozzle assembly from the spray box also removes the nozzles, and hence makes it simple and easy to inspect the spray nozzles and to repair or replace the nozzles (and/or other equipment such as the immersion pump, thermocouple or heater) should they become clogged, damaged or otherwise unusable. As an additional benefit, removing the immersion pump provides easy access to the salt furnace for inspection thereof.

It has been determined that the characteristics of time, strip and salt temperature, and salt quantity and composition are factors in determining the most efficient and effective process for spraying salt on the metal strip. In particular, for an alloy comprising type 316 stainless steel, it has been determined that a reaction time of approximately one (1) second to one and one-half (1.5) seconds is preferred to provide proper descaling. However, it is believed that proper descaling can be achieved if the salt contacts the metal strip for periods of up to 5 seconds. The reaction time is determined by strip speed (typically 30 to 400 ft/min (9–120 m/min) and the distance between the salt spray and the steam wipes.

The reaction and reaction time are also dependent upon the strip temperature and the applied salt temperature. It has been determined that the strip temperature is the more important of the two because the mass of the steel strip is much greater than the mass of the applied salt. The lower temperature limit of the strip is about 1000° F. (538° C.), which is determined by the reactivity of the salt with the surface of the metal strip, and is preferably about 1100° F. (593° C.). The upper limit of the strip temperature is determined by the point where chemical overconditioning and distortion of the strip occurs when the hot, thin strip is rapidly cooled, and is typically about 1200 degrees F. (649 degrees C.).

When used for descaling austenitic stainless steel (e.g., 304 and 316), the molten salt for the descaling system is preferably a salt of sodium and potassium hydroxide eutectic with about 10% by wt. of potassium nitrate. The eutectic is preferably a 50—50 mole ratio which is 58% by weight KOH and 42% by weight NaOH. However, other salts such as those manufactured by the assignee of the present invention under the trademarks "DGS" and "K6" can also be used. The above types of salt are sprayed through the nozzles in molten droplets. However, as described previously, these salts can also be applied from the spray chamber as a continuous stream impinging directly on the metal strip.

Finally, a minimum quantity of salt is necessary to descaling of the hot metal strip. It has been determined that for an effective reaction, preferably at least 50 grams of descaling salt per square meter of surface should be sprayed on the strip.

When the descaling salt is applied to the metal strip using the parameters described above, efficient and effective descaling of the strip is achieved. As indicated previously, the present invention is also applicable to metal strip formed from other alloys. The reaction time, strip and salt temperature and quantity of salt can vary slightly with these other alloys, however, these parameters are easily determined by simple experimentation which are well within the level of skill of those knowledgeable in the art.

After the metal strip passes through the spray area 35 and the molten salt is applied to the metal strip, the strip enters the steam wipe area 37 (FIGS. 1–3). The steam wipe area 37 includes an array of steam nozzles which are directed downwardly toward the upper surface, and an array of steam nozzles which are directed upwardly toward the lower surface of the metal strip, to remove the excess molten salt if necessary after the descaling reaction has occurred. The upper and lower arrays of steam nozzles direct steam at approximately 225° F. (107° C.) to 900° F. (482° C.) at a pressure of 15 to 40 pounds per square inch against the upper and lower surfaces of the steel strip to distribute and remove the excess salt.

The steam nozzle arrays include a first set of upper steam headers 100A, 100B which are fluidly connected to a steam inlet 102 (FIG. 2) by piping 103. The headers 100A, 100B include nozzles, indicated generally at 104A in FIG. 1, which direct the steam from inlet 102 downwardly on the upper surface of the metal strip. A similar set of lower steam headers 100C, 100D having nozzles 104B are also connected to steam inlet 102 and direct steam upwardly toward the lower surface of the metal strip at approximately the same location in the line as the upper steam headers 100A, 100B. Brackets 105A, 105B, and 105C, 105D (FIG. 2) mount the headers 100A, 100B and 100C, 100D respectively, to the inside surface of the spray chamber.

Similarly, a second and third set of upper steam headers 106A, 106B and 107A, 107B are mounted downstream of the first steam headers 100A, 100B to apply steam downwardly through nozzles 108A, 108B against the upper surface of the strip. Similar sets of lower steam headers 106C, 106D and 107C, 107D are also provided to apply steam upwardly through nozzles 108B, 109B, respectively, against the lower surface of the metal strip at approximately the same location in the line as the upper steam headers. The second and third sets of headers are also fluidly connected to the steam inlet 102 by piping 103 and include mounting brackets 112A, 112B, and 113A, 113B, respectively, to mount these headers to the inside surface of the spray box.

The first, second and third sets of headers are preferably mounted in a "V"-shaped arrangement to apply the steam downwardly and outwardly (and upwardly and outwardly) respectively against the upper and lower surfaces of the metal strip respectively. The V-shaped arrangement facilitates coating the metal strip with the molten descaling salt as the steam "pushes" the salt backward on the strip as the strip travels through the spray box. In particular, the first set of upper and lower headers primarily provide salt distribution across the strip, while the second or third sets of upper and lower headers primarily push the salt off the metal strip.

This action of pushing the salt across the strip is particularly important in effectively descaling the strip should one of the salt spray nozzles in the upper or lower pair of nozzles become clogged. In this case, the headers will spread the salt across the strip to completely cover the strip regardless of the clogged nozzle. For faster metal processing speeds, the steam headers can be mounted further downstream of the spray area so that the reaction time for the salt on the metal strip is maintained within the appropriate parameters described previously.

The steam headers described above, and in particular the second and third steam headers, push the salt off the metal strip and into a catch basin or pan 120 (FIG. 3) located beneath the strip. The catch basin extends across the width of the spray box and is mounted at an angle thereto to direct the salt into the salt furnace 74 for re-use, if desired. It should be apparent that the spray chamber should be mounted higher than the salt furnace for this draining to be achieved during and after the spray process. Alternatively, the salt can run to a drain for treatment, recycling or disposal to prevent the reacted salt from mixing with fresh salt.

After the steam wipes have been applied to the strip, the strip enters the rinse area 39. The rinse area 39 includes upper and lower pairs of spray nozzles 138A, 138B, which direct water toward the upper and lower surfaces, respectively, of the metal strip. The water nozzles rinse any remaining salt off the strip that was not previously removed in the steam wipe area. The rinse area also includes upper and lower pairs of air blow-off headers 142A, 142B, which can include nozzles (not numbered) and can be shaped in a V-arrangement and direct air toward the upper and lower surfaces of the strip, respectively, to dry the strip before the strip leaves the rinse area. Excess water is collected by angled catch basin 130 and drains out through outlet piping 146.

Upon exiting the rinse area, the strip exits the spray box and is further processed e.g., in a pickling tank of 10% sulfuric acid at 130° F. (54° C.); rinsed in water; immersed in 12% nitric acid and 2% HF acid at 120° F. (49° C.); and finally rinsed again in water and dried. Other acid combinations may be used, as is known to those skilled in the art.

To operate the spray descaling system, the heater is initially activated to bring the temperature of the spray chamber and nozzles above the melting point of the salt for a predetermined period of time. Molten salt from the furnace is then pumped into the spray chamber and applied to the strip through the nozzles. Excess salt is forced off the strip by the steam wipe, and ordinarily drains back into the salt furnace for re-use. Finally, the strip is rinsed and dried in the rinse area and passes out of the spray box for further processing. When the spraying is complete, the immersion pump is deactivated and the salt is allowed to drain out of the nozzles and the spray chamber and back into the salt furnace before the heater in the spray chamber is deactivated. In this manner, salt freezing on the sides of the spray chamber and in the nozzles is prevented.

Tests have been conducted using stainless steel having an oxide layer thereon. For example, Type 304 stainless steel which was 37 inches wide and 0.04 inches thick, was run through the above-described spray descaling system at 34 feet per minute (10.4 meters per minute) with satisfactory results wherein the scale was removed and a bright, high corrosion resistant surface was provided. Additionally, type 304 stainless steel, 32 inches wide and 0,081 inches thick, was run through the spray descaling system at 30 feet per minute (9 meters per minute) also with satisfactory results. Further, type 304 stainless steel, 37-inch wide and 0.04 inches thick, was run through at 50 feet per minute (15 meters per minute).

Accordingly, as described above, the present invention provides a new and useful spray descaling system for an annealing line of a production facility. The system is effective and efficient in descaling metal strip after the strip emerges from an annealing furnace, and prior to pickling in an acid bath. The present invention provides nozzles mounted to a self-contained nozzle assembly which can be easily attached to and removed from the spray descaling system, inspected, and the nozzles and other associated components repaired or replaced if necessary.

Although the invention has been described with respect to a certain preferred embodiment, it is obvious that equivalent alterations and modifications will occur to those skilled in the art upon their reading and understanding of the specification. For example, annealing conditions, atmosphere and strip speed can have some effect on the time, strip and salt temperature, and salt quantity necessary to provide an effective and efficient salt descaling system. The present invention includes all such equivalent alterations and modifications, and is only limited by the scope of the following claims.

What is claimed is:

1. An apparatus for descaling a strip of metal having upper and lower surfaces moving in a metal processing line, comprising:

a chamber for containing a molten descaling product, means for heating the chamber and for heating the descaling product in said chamber to a consistency in which the descaling product can be applied through a nozzle device, and a first nozzle device fluidly connected to and in heat exchange relationship with said chamber, said first nozzle device being heated by the chamber and being oriented to direct the molten descaling product from the chamber against one surface of the metal strip to descale the surface of the metal strip.

2. The apparatus as in claim 1, wherein said first nozzle device is mounted directly to said chamber.

3. The apparatus as in claim 2, wherein said first nozzle device is conductively heated by the chamber.

4. The apparatus as in claim 3, further including a second nozzle device mounted directly to said chamber, said second nozzle device being conductively heated by the chamber and being oriented to direct the descaling product from the chamber against the other surface of the metal strip to descale the other surface of the metal strip.

5. The apparatus as in claim 4, wherein said chamber is mounted off to the side of the strip of metal such that said first and second nozzle devices direct the descaling product transversely across the strip at downward and upward angles, respectively, thereto.

6. The apparatus as in claim 4, wherein said means for heating the chamber and for heating the descaling product in said chamber comprises a heater mounted to said chamber and extending inwardly into the chamber.

7. The apparatus as in claim 6, wherein the heater heats the chamber, the descaling product in the chamber, and the first and second nozzle devices to a temperature such that the descaling product can be applied through said nozzle devices at a temperature above the melting point of the descaling product.

8. A system for descaling a strip of metal having upper and lower surfaces traveling at a predetermined speed in an annealing line of a production facility, comprising:

a spray box through which the strip of metal passes, a chamber mounted at least partially within said spray box for receiving and storing a molten descaling product, means to heat the chamber and to heat the descaling product in said chamber to a consistency in which the descaling product can be applied through a nozzle device, and a first nozzle device fluidly connected to and in heat exchange relationship with said chamber, said first nozzle device being heated by the chamber and being oriented to direct the molten descaling product from the chamber in a spray against one surface of the metal strip as the strip passes through the spray box to descale the surface of the metal strip.

9. The system as in claim 8, wherein said nozzle device is mounted directly to and conductively heated by said chamber.

10. The system as in claim 9, further including a second nozzle device mounted directly to said chamber, said second nozzle device being conductively heated by the chamber and being oriented to direct the molten descaling product from the chamber against the other surface of the metal strip.

11. The system as in claim 10, further including a wipe apparatus mounted within said spray box, said wipe apparatus providing a stream of fluid against the surfaces of the metal strip after the descaling product is applied to the strip to spread the descaling product across the surfaces of the strip and to remove excess descaling product from the strip.

12. The system as in claim 11, wherein said wipe apparatus includes a steam wipe, and the stream of fluid from said wipe apparatus is steam.

13. The system as in claim 11, further including a catch basin or pan to receive the descaling product after being removed from the surfaces of the metal strip by the wipe apparatus.

14. The system as in claim 11, wherein said nozzle devices on the spray chamber and the wipe apparatus are mounted within the spray box in such a manner that the nozzle devices direct the descaling product from the chamber against the surfaces of the metal strip such that the descaling product contacts the surfaces of the metal strip for 5 seconds or less before being removed by the stream of fluid from the wipe apparatus.

15. The system as in claim 10, wherein said chamber is removably mounted to said spray box and can be removed and replaced if the nozzle device becomes damaged or clogged.

16. The system as in claim 15, wherein said nozzle devices are mounted off to the side of the strip of metal such that said nozzle devices direct descaling product transversely across the strip at downward and upward angles, respectively, thereto.

17. The system as in claim 10, further including a salt furnace for receiving and at least temporarily storing the descaling product, said salt furnace having heating means for maintaining the descaling product in a molten state prior to introduction to the chamber.

18. A descaling system for descaling a strip of metal having upper and lower surfaces in an annealing line, comprising:

a spray box through which the strip of metal passes in the annealing line, a nozzle assembly removably mounted to said spray box, said nozzle assembly including:

a chamber for containing a molten descaling product, heating means to heat the descaling product in said chamber to a consistency in which the descaling product can be applied through a nozzle device, said heating means being mounted to said chamber, and a nozzle device mounted directly to said chamber, said nozzle device being oriented to direct the molten descaling product from the chamber against a surface of the metal strip as the strip passes through the spray box to descale the surface of the metal strip, said chamber being removable from said spray box to allow inspection and/or replacement of said nozzle device and said heating means if said nozzle device and said heating means become damaged or clogged.

19. A descaling system for descaling a strip of metal having upper and lower surfaces in an annealing line, comprising:

a spray box through which the strip of metal passes in the annealing line, a nozzle assembly removably mounted to said spray box, said nozzle assembly including:

a chamber for containing a molten descaling product, the descaling product consisting essentially of sodium and potassium hydroxide eutectic with about 10% by wt. of potassium nitrate, heating means to heat the descaling product in said chamber to a consistency in which the descaling product can be applied through a nozzle device, said heating means being mounted to said chamber, and a nozzle device mounted directly to said chamber, said nozzle device being oriented to direct the molten descaling product from the chamber in a spray against a first surface of the metal strip as the strip passes through the spray box to descale the surface of the metal strip, said chamber being removable from said spray box to allow inspection and/or replacement of said nozzle device and said heating means if said nozzle device and said heating means become damaged or clogged.

* * * * *